US005240142A

United States Patent [19]

Reid

[11] Patent Number: 5,240,142

[45] Date of Patent: Aug. 31, 1993

[54] ARTICLE DISPENSING APPARATUS

[76] Inventor: John N. Reid, Whiteoak, Barling Road, Great Wakering, Essex SS3 0ND, England

[21] Appl. No.: 651,219

[22] PCT Filed: Jul. 31, 1989

[86] PCT No.: PCT/GB89/00871

§ 371 Date: Mar. 20, 1991

§ 102(e) Date: Mar. 20, 1991

[87] PCT Pub. No.: WO90/01757

PCT Pub. Date: Feb. 22, 1990

[30] Foreign Application Priority Data

Aug. 6, 1988 [GB] United Kingdom ..... 8818720
May 24, 1989 [GB] United Kingdom ..... 8911927

[51] Int. Cl.[5] ..... G07F 11/64

[52] U.S. Cl. ..... 221/129; 221/130; 221/289; 221/13; 221/90; 221/194; 221/197; 211/59.2

[58] Field of Search ..... 221/129, 130, 131, 69, 221/289, 2, 4, 5, 7, 10, 13, 3, 194, 197, 89, 90; 222/54; 248/550; 211/59.1, 59.2

[56] References Cited

U.S. PATENT DOCUMENTS

| | | | |
|---|---|---|---|
| 3,090,521 | 5/1963 | Fazekas | 221/197 X |
| 3,163,276 | 12/1964 | McLaughlin | 221/69 X |
| 3,248,005 | 4/1966 | Joschke | 221/129 X |
| 3,263,857 | 8/1966 | Krakauer et al. | 221/129 X |
| 4,209,211 | 6/1980 | Alford | 221/13 X |
| 4,225,056 | 9/1980 | Flubacker | 221/2 |
| 4,629,090 | 12/1986 | Harris et al. | 221/7 |
| 4,634,021 | 1/1987 | Davis | 221/289 X |

FOREIGN PATENT DOCUMENTS

| | | |
|---|---|---|
| 3741053 | 6/1988 | Fed. Rep. of Germany . |
| 135678 | 5/1978 | German Democratic Rep. . |

*Primary Examiner*—Robert P. Olszewski
*Assistant Examiner*—Dean A. Reichard
*Attorney, Agent, or Firm*—Dellett, Smith-Hill and Bedell

[57] ABSTRACT

Dispensing machines are described which are suitable for use in a cold environment. The machines have a plurality of storage locations for supporting articles to be dispensed, each of which includes an electrical heating element. The heating elements can be energized individually and the heat generated by an energized heating element causes an article supported at the respective storage location to be released.

15 Claims, 2 Drawing Sheets

ARTICLE DISPENSING APPARATUS

The present invention relates to article dispensing apparatus. The invention provides article dispensing apparatus particularly suitable for use in cold environments, for example in dispensing items of frozen food in an automatic vending machine, but is not restricted to such applications.

There have been many proposals to combine a freezer compartment with a microwave oven in order to permit automatic vending of hot food, such as hamburgers. A serious problem to be overcome in the construction of such a machine is that the mechanism employed to select an item from the freezer compartment and transfer it to the oven tends itself to freeze and eventually to fail through the accumulation of frost.

There have been proposals in the prior art to utilise heat as a means of releasing an article from a storage location in a dispensing machine. In U.S. Pat. No. 3,163,276, the articles to be dispensed are supported on hooks by means of retaining elements which are weakened or broken when the hooks are heated. In GB-851,100, each article to be dispensed is suspended from a lever which is prevented from rotating by a detent formed of a bimetallic strip. When the strip is electrically heated, it bends out of the way of the lever and allows the latter to pivot under the weight of the suspended article, which is then released from its storage location.

It is important to be able to ascertain that sufficient heat has been applied to, release an article from a storage location. In U.S. Pat. No. 3,163,276, a mechanical switch is provided at each location to sense when an article has been released. This requires several sensing switches and the reliability of such sensing switches cannot be guaranteed in a frozen environment.

With a view to mitigating the foregoing disadvantages found in the prior art, the present invention provides a dispensing machine having a plurality of storage locations for supporting articles to be dispensed, each location including a respective electrical heating element, and means for supplying current to the individual heating elements to enable a selected article to be dispensed, the heat generated by an energised heating element causing an article to be released from the storage location and to pass along a dispensing chute, characterised in that means are provided for monitoring the passage of articles along the dispensing chute and for controlling the power supply to the heating elements of the storage locations to ensure that a selected article is dispensed.

It is possible to continue to apply current to the heating element of a storage location for as long as is necessary for the article to be released and to be sensed as it passes through the dispensing chute. Alternatively, one may apply current for a length of time which is predetermined to be sufficient to release an article under most operating conditions. If no article should be detected on the chute by the end of the heating time, one may in this case either make a further attempt at retrieving an article from the same storage location or attempt to retrieve a similar article from another storage location.

Though the invention is designed with the aim of providing reliable operation in a cold environment, the use of heat as the means for releasing an article to be dispensed, makes for a simple, inexpensive and inherently reliable construction which can be used in a wide variety of vending machines, even where temperature presents no problem.

In a preferred embodiment of the invention, each storage location comprises a hook from which an article to be dispensed can be suspended, the application of heat to the hook being capable of releasing the suspended article.

The articles to be dispensed may conveniently be packaged in containers each having a portion from which the container can be suspended, at least the portion of the container from which it can be suspended being made of a material capable of being softened or melted by the application of heat to the hook and wherein the heat applied to the hooks serves to weaken the container so that it may fall off the hook under its own weight.

As an alternative, each hook may be formed in such a manner that it changes shape on the application of heat to permit the article to fall under its own weight. In this case, each hook may include a bimetallic portion which bends on the application of heat to retract the hook from the container.

Because each article is suspended under its own weight, no transport mechanism with moving components is needed. Once a container is released, it falls into the dispensing chute and travels along the chute out of the dispensing apparatus. The only point at which freezing can create a problem is in the releasing of the article from the hook and, since in the invention the release is effected by applying heat to the hook, this problem is avoided.

Embodiments of the invention employing a heated hook can thus be seen to provide an elegant solution to the dispensing of articles, which even works reliably for items of food stored in a freezer.

The heating element may be disposed within each hook but it is preferred, when using containers of which the point of suspension can be softened, for the hook itself to constitute the heating element, it being formed of a length of resistance wire which can be connected across a power supply.

A limitation of the embodiments using a heated hook is that the article to be dispensed must be packaged in such a manner that it can be suspended and this is not always convenient. For example, where the article is a packet containing food, such as potato chips, there may be no space available to puncture the packet to form a hole from which the product can be suspended.

To mitigate this problem, in accordance with a further feature of the invention, support means may be provided at each storage location which are movable under the action of a return force from a first position in which an article to be dispensed is prevented from falling out of the storage location to a second position in which the article is not supported, each storage location further comprising a temperature sensitive detent for holding the support means in said first position against the action of the return force, the electrical heating element of the storage location serving to heat the detent to cause the support means to be released when an article is to be dispensed.

The support means of each storage location may be constituted by a shelf on which the article rests. The return force acting on the shelf may be exerted by a spring acting to urge the shelf into its second position but it is preferred to rely on gravity.

Alternatively, the support means may be formed as a clasp having jaws for gripping the articles to be dispensed, the jaws being held in their closed first position by means of the detent which opposes the action of a spring acting to open the jaws.

The jaws may advantageously have elastomeric pads to provide a good frictional grip and to permit the jaws to be closed slightly beyond the point at which the article is firmly gripped between the jaws so as to allow the detent to re-engage the jaws reliably.

The detents may suitably include bimetallic strips which are heated by passing a current through them.

Once the shelf is allowed to drop out of the way of the article, or the jaws gripping the article are released, the article to be dispensed falls under its own weight into a chute and travels along the chute out of the dispensing apparatus.

The storage locations are conveniently arranged on vertical trays which may be withdrawn from the dispensing apparatus for refilling. On the trays, the locations may be disposed in rows and columns so that the heating elements associated with the hooks or detents may be connected in a matrix, thereby reducing the number of connecting wires required and simplifying the selection of the individual heaters.

Of course, when articles are stacked vertically one above the other, care must be taken to ensure that the fall of an article should not be impeded by other articles still supported beneath it. If an article can collide with others beneath it then this problem can be avoided by releasing articles in the correct order from a stack, namely lowermost article first.

Advantageously, the vertical trays may be shaped to include a ramp above each location so that an article released from one location does not collide with the support means or hook disposed in the same column during its fall towards the dispensing chute.

The invention will now be described further, by way of example, with reference to the accompanying drawings, in which.

Figure 1:
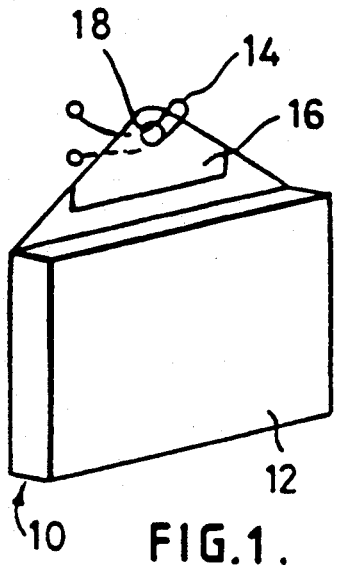
FIG. 1 is a perspective view of a container for an article of food to be dispensed from a freezer compartment.

The container 10 in FIG. 1 is a cardboard box 12 or possibly a paper or polyethylene bag containing a food article to be dispensed. The construction of this part of the container is not relevant to the invention. The box 12 is designed to be suspended from a hook 14 and, to this end, it is provided with a flap 16 having a hole 18 through which the hook 14 passes. At least the flap 16 is made of a material, such as polypropylene, which softens with the application of heat.

Figure 2:
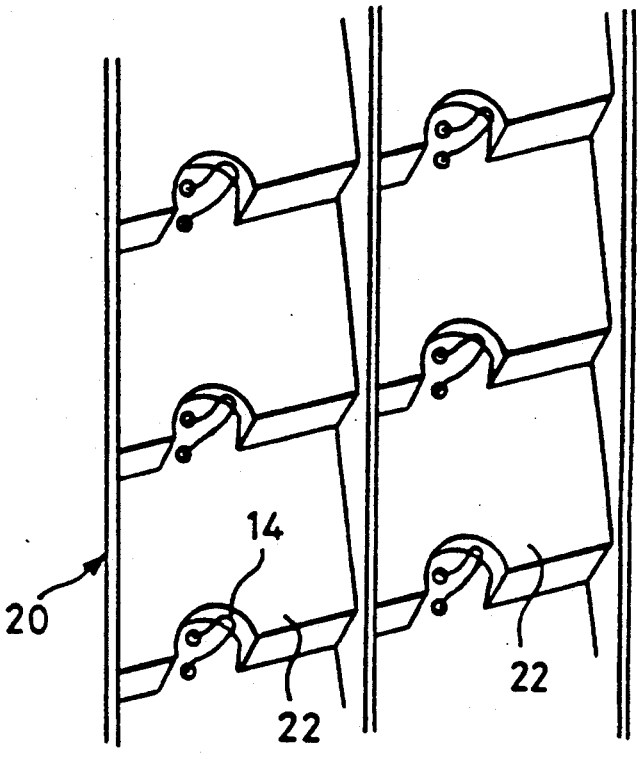
FIG. 2 is a schematic partial perspective view of a tray for supporting containers as shown in FIG. 1.

The tray 20 shown in FIG. 2 is intended to be stacked vertically in a freezer compartment and is made of an electrically insulating plastics material suitable for this purpose. The tray is formed with hooks 14 arranged in several rows and columns, each being intended to support a container 10 of the type shown in FIG. 1.

The hooks 14 in the embodiment of FIGS. 1 and 2 are formed of resistance wire and the reverse side of the tray 20 carries conductors which lead to the individual hooks to permit any selected hook to be heated separately. The conductors may be row and column conductors applied as a printed circuit to the trays or may comprise individual wires.

The trays are not flat but are shaped with ramps 22. The ramped surface is designed to prevent a container falling from a higher hook being accidentally impeded from falling by a lower hook 14. Thus the ramps need to project further than the hooks 14.

The individual trays are intended to slide in and out of a rack system disposed in a freezer compartment, in a manner similar to the mounting of the printed circuit boards of a computer. This simplifies loading of the trays and enables efficient utilisation of the space within the freezer compartment.

In use, any given column on a tray should be loaded with goods of the same type. When this article is selected for dispensing the hook of the lowermost occupied position in that column is heated by passing current through it, the hook being itself made of resistance wire. The heat generated melts the plastics material of the flap 16 above the suspension hole 18 and the container falls under its own weight into a compartment from which it can be collected by the user. During its fall it is unimpeded by the hooks 14 beneath it, as it is guided over them by the ramps 22.

The advantages of the dispensing mechanism are its inherent simplicity and also its reliability under cold operating conditions, such as in a freezer compartment of a hot food vending machine. Each container is separately supported and cannot be frozen together with other containers. The main problems caused by freezing occur at the point of release and in the present invention since heat is applied to effect the release, the effects of temperature are totally circumvented.

Figure 3:
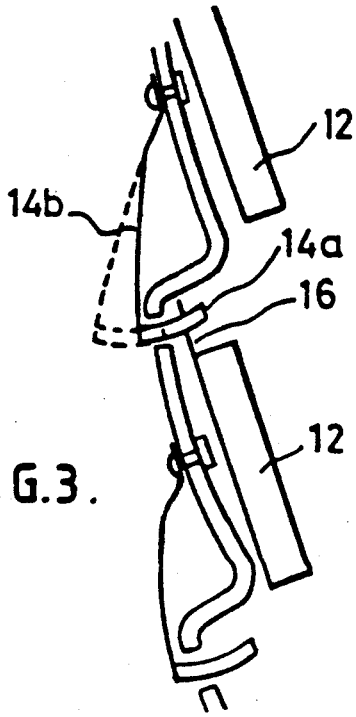
FIG. 3 shows a partial section through a tray of an alternative embodiment of the invention.

The hooks need not constitute the heating elements and it is alternatively possible to provide separate heaters to heat the hooks. Further, the effect of the heat need not be to act on the container but it may act on the hook to make it retract or change shape so as to release the container. Such an embodiment is shown in FIG. 3 in which the boxes 12 have portions 16 which are slipped onto a hook **14*a* which is mounted on the lower end of a bimetallic strip 14*b*. As it is heated by an electric current, the bimetallic strip bends to the position shown in dotted lines and the hook 14*a* is retracted from the part 16 from which the box 12** is suspended.

The essential feature of the invention is that the release of the container 10 from a hook 14 is effected by the application of heat so as to avoid problems caused by freezing of the release mechanism.

Once the container has been released in a hot food vending machine, it will fall into a microwave oven which will first heat the article and then open a door to allow the heated food article to be retrieved by the user.

It is possible to monitor the falling of a container into the microwave oven in order to ensure that an article has been dispensed. Such monitoring can be effected optically, electrically or mechanically depending on the nature of the container. If an article is not dispensed, the steps may be taken to activate the heat hook a second time and if necessary to attempt to retrieve a similar article from another hook if all prior attempts fail.

The dispensing of a food article in such a food vending machine can be effected under micro-computer control, the computer serving to select the hook to be heated in dependence upon the selection made by the user and also to synchronise the operation of the door mechanism and the oven. The oven can furthermore be energised for different lengths of time, depending on the article to be heated.

Figure 5:
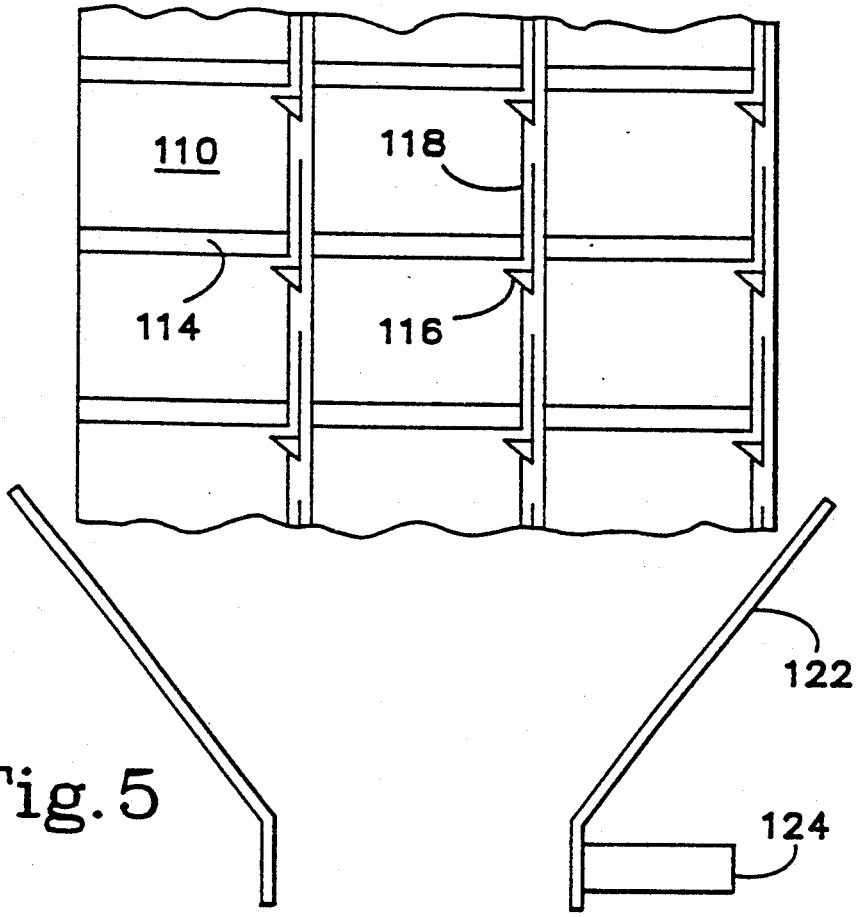
FIG. 5 shows a front view of the tray in FIG. 4.
Figure 4:
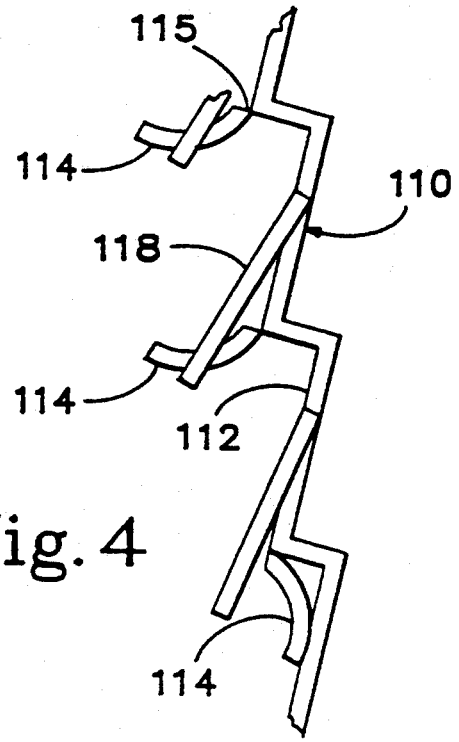
FIG. 4 shows a partial section through a tray of a dispensing machine in accordance with a second embodiment of the invention.
Figure 6:
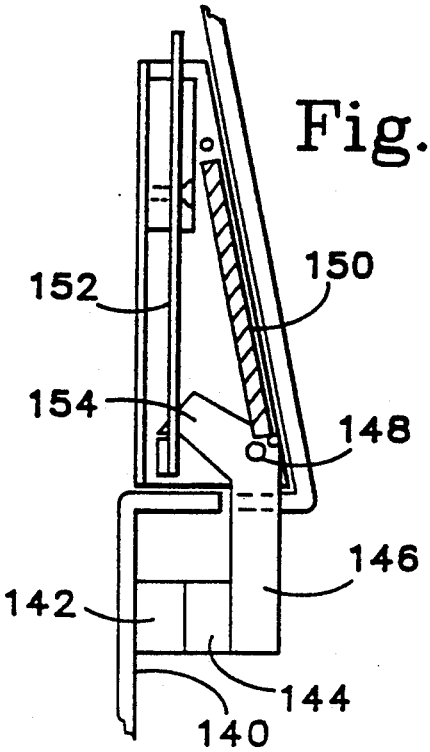
FIG. 6 is a partial section through a tray of a further embodiment of the invention.

The embodiments of FIGS. 4 to 6 are generally similar to those described above and differ only in the construction of the storage locations.

The machine comprises vertical trays made of a plastics material or glass fibre resin which can slide in and out of horizontal guide rails mounted on a rack disposed above a dispensing chute 122 provided with a sensor 124. Each tray is divided into rows and columns of locations at which articles to be dispensed can be stored and has a ramp at each such location so that an article sliding on the tray automatically rides over and clears the obstruction posed by the support means for the articles beneath it.

Each location has heating means for releasing an article to be dispensed. For ease of wiring, the heating means are connected at the intersection of individually excitable row and column conductors arranged as a matrix on the trays. The row and column conductors can be printed onto the reverse of the trays, if desired.

FIGS. 4 to 6 do not show the entire dispensing machine but only show the construction of the individual storage locations on the vertical trays on which the articles are supported.

In FIGS. 4 and 5, the tray is designated 110 and has a plurality of ramps 112 arranged one above the other in individual columns. At the lower end of each ramp, there is a hinged shelf 114 which is held against its own weight by a nose 116 at the end of a bimetallic strip 118 disposed in the partition wall between the columns of storage locations.

In FIG. 4, the upper two shelves 114 are in their raised position and are held there by the noses 116 of the bimetallic strips 118. In this position, an article can be supported on each shelf 114. When an article is to be dispensed from a column, the bimetallic strip 118 of the lowest full storage location in the column is heated by passing a current through it. This causes the bimetallic strip 118 to bend to the right, as viewed in FIG. 5, so that the nose 116 of the strip 118 is retracted from beneath the shelf 114 and the latter pivots about its hinge 115 to let the article resting on it fall under its own weight towards the dispensing chute 122. Passage of the article along the chute is monitored by the sensor 124. After the article has fallen, the current heating the bimetallic strip 118 is discontinued and the strip again returns to its illustrated position.

To load the tray, the whole tray is first withdrawn by sliding it out of its guide rails in the dispensing machine. Each shelf 114 is then raised manually to deflect the nose 116 until it re-engages beneath the shelf 114 and a new article to be dispensed is then placed on the shelf. When all the storage locations have been replenished, the tray can be pushed back into the machine.

It is an advantage of the machine described above that it can achieve a high packing density. To this end, the trays are preferably spaced apart closely in the machine, the spacing depending on the size of the article to be dispensed. The space between a raised shelf 114 and the adjacent vertical tray is selected to be too small to allow an article to pass. In this way, the machine is less prone to vandalism as an article cannot be dispensed by shaking the machine to dislodge an article off its support shelf 114.

The embodiment of FIGS. 4 and 5, is not restricted as to the shape or size of the article to be dispensed and no modification is required to the packaging of the article.

The embodiment of FIG. 6 is intended for articles, such as packets of potato chips, which have an edge that can be gripped by a pair of jaws. At the top of each ramp 140 there is arranged a pad 142 of foam rubber which acts as a fixed jaw. A second pad 144 of foam rubber 144 is mounted on the end of one arm of a two armed lever 146 and acts as a movable jaw.

The lever 146 is pivoted about a pin 148 and is urged to rotate counter-clockwise as viewed by a return spring 150. A nose 154 is formed by the end of the second arm of the lever 146 which engages one end of a bimetallic strip 152 to hold the jaws in their closed position, as illustrated.

When current is passed through the bimetallic strip 152 to heat it, it is deflected to the left as viewed until it clears the nose 154 on the lever 146. The lever 146 is then pivoted by the spring 150 in a direction to open the jaws and allow the article to fall out of the jaws under its own weight. The bimetallic strip 152 returns to its straight position when the current through it is discontinued.

To re-load the storage location, the edge of a packet is placed between the jaws and the latter are closed manually against the action of the spring 150. The nose 154 of the lever 146 deflects the bimetallic strip 152 until it re-engages beneath the nose 154. The compressibility of the rubber jaws allows some latitude to permit the nose 154 to re-engage correctly and to permit the jaws to grip the article firmly despite variations in the thickness of the packet.

In all embodiments described above, means may be provided to monitor when an article falls onto the dispensing chute in order to discontinue the heating of the bimetallic strip or the detent.

It is alternatively possible to monitor the position of each support means, that is to say the shelf 114 or lever 146. For example, each support means may in its raised position close a contact through which current can flow to the associated bimetallic strip. When the article is dispensed, the heating current is then automatically discontinued.

A circuit may apply a voltage across the appropriate conductors and monitor the heating current and its duration. If no current flows, then a fault is present and another storage location can be activated. If the duration exceeds a preset limit, then the support means is stuck and another storage location can be activated.

I claim:

1. A dispensing machine having a plurality of storage locations for supporting articles to be dispensed, each location including a respective electrical heating element (14,118,152), and means for selectively supplying current to the individual heating elements (14,118,152), the heat generated by an energised heating element causing an article to be released from the selected storage location and to pass along a dispensing chute, characterised in that means are provided for monitoring the passage of articles along the dispensing chute and for controlling the power supply to the heating elements of the storage locations to ensure that a selected article is dispensed.

2. A dispensing machine as claimed in claim 1, wherein each storage location comprises a hook from which an article to be dispensed can be suspended, the application of heat to the hook being capable of releasing the suspended article.

3. A machine as claimed in claim 2, wherein the articles to be dispensed are packaged in containers (10) each having a portion (16) from which the container (10) can be suspended, at least the portion (16) of the container (10) from which it can be suspended being made of a material capable of being softened or melted by the application of heat to the hook and wherein the heat applied to the hooks (14) serves to weaken the container so that it may fall off the hook under its own weight.

4. A machine as claimed in claim 2, wherein each hook (14*a*,14*b*) is formed of a material that changes shape on the application of heat to permit the article to fall under its own weight.

5. A machine as claimed in claim 4, wherein each hook includes a bimetallic portion (14*b*) which bends on the application of heat to retract the hook (14*a*) from the container (10).

6. A machine as claimed in claim 3, wherein each hook (14) is constituted by a heating element, the hook (14) being formed of a length of resistance wire which can be connected across a power supply.

7. A dispensing machine as claimed in claim 1, wherein support means (114,146) are provided at each storage location which are movable under the action of a return force from a first position in which an article to be dispensed is prevented from falling out of the storage location to a second position in which the article is not supported, each storage location further comprising a temperature sensitive detent (116,118; 152) for holding the support means (114, 146) in said first position against the action of the return force, the electrical heating element of the storage location serving to heat the detent to cause the support means to be released when an article is to be dispensed.

8. A machine as claimed in claim 7, wherein the support means of each storage location comprises a shelf (114) on which the article may rest.

9. A machine as claimed in claim 8, wherein the return force on the shelf (114) is exerted by gravity acting to urge the shelf into its second position.

10. A machine as claimed in claim 7, wherein the support means is a clasp having jaws (142,146) for gripping an article to be dispensed, the jaws being held in their closed first position by means of the detent (152,154) which opposes the action of a spring (150) acting to open the jaws.

11. A machine as claimed in claim 10, wherein the jaws have elastomeric pads (142,144) to provide a good frictional grip and to permit the jaws to be closed slightly beyond the point at which the article is firmly gripped between the jaws so as to allow the detent to re-engage the jaws reliably.

12. A machine as claimed in claim 7, wherein the detents include bimetallic strips (118) which are electrically heated.

13. A machine as claimed in claim 7, wherein the storage locations are arranged in rows and columns on vertical trays, and wherein each vertical tray includes a ramp (22) above each storage location so that an article released from one location should not collide with the support means disposed in the same column during its fall.

14. A machine as claimed in claim 2, wherein the storage locations are arranged in rows and columns on vertical trays, and wherein each vertical tray includes a ramp (22) above each storage location so that an article released from one location should not collide with the hook disposed in the same column during its fall.

15. A machine as claimed in claim 1, wherein the storage locations are arranged in rows and columns on vertical trays.

* * * * *